US005458508A

United States Patent [19]

Sawada

[11] Patent Number: 5,458,508

[45] Date of Patent: Oct. 17, 1995

[54] METHOD AND APPARATUS FOR CONNECTING AN ELECTRICAL COMPONENT TO A HOUSING

[75] Inventor: Hisashi Sawada, Yokkaichi, Japan

[73] Assignee: Sumitomo Wiring Systems, Ltd., Yokkaichi, Japan

[21] Appl. No.: 288,209

[22] Filed: Aug. 9, 1994

[30] Foreign Application Priority Data

Sep. 6, 1993 [JP] Japan ..... 5-053385 U

[51] Int. Cl.[6] ..... H01R 13/70

[52] U.S. Cl. ..... 439/620; 439/516; 335/205

[58] Field of Search ..... 439/516, 620–622, 439/76; 200/302.1; 335/205–207

[56] References Cited

U.S. PATENT DOCUMENTS

| | | | |
|---|---|---|---|
| 4,699,445 | 10/1987 | Porta et al. | 439/620 |
| 5,026,305 | 6/1991 | Del Guidice et al. | 439/620 |
| 5,120,231 | 6/1992 | Masumoto | 439/76 |

FOREIGN PATENT DOCUMENTS

| | | | |
|---|---|---|---|
| 2-78463 | 6/1990 | Japan . | |
| 478323 | 7/1975 | U.S.S.R. | 439/621 |
| 1574356 | 9/1980 | United Kingdom . | |
| 1587998 | 4/1981 | United Kingdom . | |
| 2086140 | 5/1982 | United Kingdom . | |

*Primary Examiner*—Gary F. Paumen
*Attorney, Agent, or Firm*—Oliff & Berridge

[57] ABSTRACT

Terminals are formed on an electrically-conductive plate supporting a reed switch, and the terminals are extended through a resin holder. The holder is inserted into a connector housing and is fixedly secured within the housing by fusion.

13 Claims, 3 Drawing Sheets

METHOD AND APPARATUS FOR CONNECTING AN ELECTRICAL COMPONENT TO A HOUSING

BACKGROUND OF THE INVENTION

This invention relates to connectors of the type that include a housing that contains an electrical component such as a reed switch. More particularly, this invention relates to a method and apparatus for connecting the housing and the electrical component, which assembly is further connected to an automobile or the like.

Various kinds of hydraulic systems are incorporated in an automobile, and in order that such a hydraulically-operated mechanism can always be kept in a normal condition, it is necessary to monitor the system to determine whether the amount of pressurized oil in the system is above a predetermined level. One known construction includes a reed switch mounted on a portion of a reservoir body, and when a float contained in the reservoir body moves down to a predetermined level, the reed switch is activated by magnetic force of the float to monitor the amount of pressurized oil. The reed switch used here is incorporated in a connector, and its construction is shown in FIG. 4.

The reed switch 30 is housed in a tubular connector housing 31 having one open end. The reed switch is entirely supported by a support member 32 provided beneath the reed switch, and the support member 32 also supports a pair of terminal pieces 33 (only one of which is shown in FIG. 4) for connection to a mating connector (not shown). The two terminal pieces 33 are connected respectively to electrodes 34 extending from the reed switch 30. The front end portion of each of the two terminal pieces 33 penetrates through a rubber bushing 35 for sealing purposes, and is supported by the bushing. The rubber bushing 35 is held by a retainer bushing 38 against withdrawal, and the retainer bushing 38 is fixed by retaining pawls 36 engaged in notch holes 37 formed in the open end portion of the connector housing 31.

In the connector of the above construction, however, the reed switch 30 and the two terminal pieces 33 require a common support member 32 and a retainer bushing 38. Thus, the number of the constituent parts is large, so that the internal structure is complicated. Because of the large number of the constituent parts, the assembling operation cannot be carried out easily, and the efficiency of the operation is low.

It has been proposed to provide the rubber bushing with a retaining function in order to omit the use of the retainer bushing 38. For example, elastic pawls are formed on the rubber bushing, and are engaged with the housing. With this construction, however, the retaining force provided by the rubber material cannot withstand a withdrawing load applied by the mating connector.

SUMMARY OF THE INVENTION

The present invention has been made in view of the above problems, and an object of the invention is to provide a connector that is simplified in construction, and can enhance the efficiency of an assembling operation.

The above object has been achieved by a connector, in a first aspect of the invention, comprising a housing having at one end an insertion port for receiving a mating connector; a plate supporting an electrical component received in the housing, the plate having terminals; and a holder through which front end portions of the terminals extend toward the insertion port in a press-fitted manner, the holder being fused to the housing in such a manner that the holder is entirely fitted in the housing.

In accordance with another aspect of the invention, there is provided a method for mounting an electrical component within a housing. The method comprises the steps of fitting terminals of a plate of the electrical component with a holder, connecting electrodes of the electrical component with respective ones of the terminals to form an assembly, inserting the assembly into the housing until the holder engages stop ridges located in the housing, and welding the holder to the housing.

In yet another aspect of the invention, there is provided a connector for receiving a mating connector, comprising a housing adapted to receive a plate that includes terminals and supports an electrical component, a holder through which the terminals extend, and means for sealing and fixing the holder to the housing.

When the electrical component is to be incorporated into the connector housing, the electrical component is supported on the plate, and also the terminals of the plate are press-fitted in the holder, thus integrally connecting these parts. These parts are provisionally fitted in the connector housing and the holder is fixedly secured to the inner surface of the connector housing by fusion. Thus, the electrical component and the plate are incorporated in such a manner that they are prevented by the holder from withdrawal.

The electrical component is supported directly on the plate having the terminals, and the fusion of the holder obviates the need for any special withdrawal prevention member as used in the conventional construction. Therefore, the internal structure of the connector can be simplified. Therefore, the efficiency of the assembling operation is enhanced, and manufacturing costs can be reduced.

BRIEF DESCRIPTION OF THE DRAWINGS

The invention will be described in detail with reference to the following drawings wherein.

DETAILED DESCRIPTION OF PREFERRED EMBODIMENTS

Figure 1:
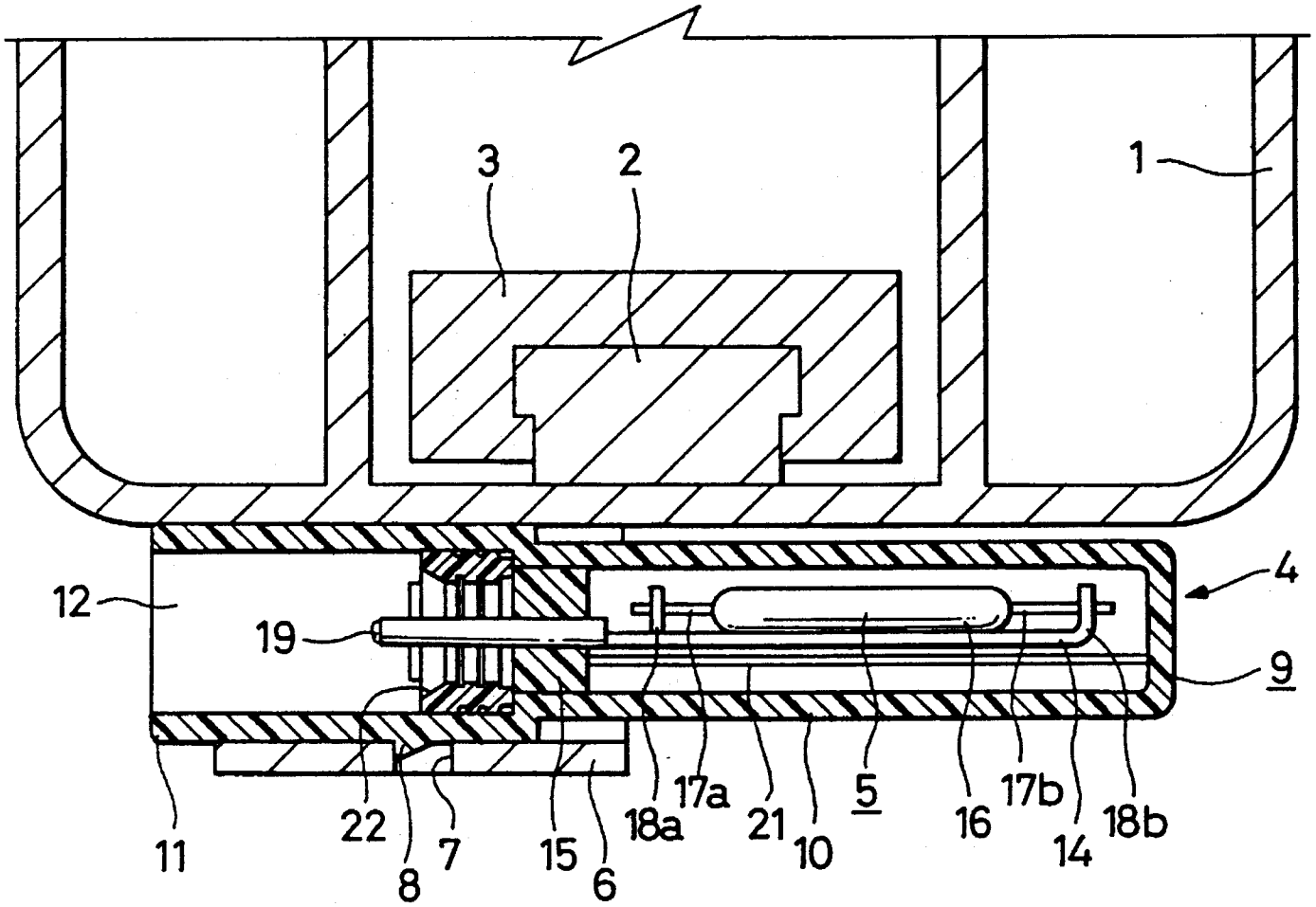
FIG. 1 is a vertical cross-sectional view of a connector of the present invention that is mounted on a reservoir body.

A preferred embodiment of the present invention will now be described in detail with reference to the drawings. FIG. 1 shows a connector mounted on a reservoir body 1. A float 3 with a permanent magnet 2 is provided as a level sensor within the reservoir body 1. The connector 4 is mounted on a bottom surface of the reservoir body 1, and a reed switch 5, which is turned on and off in accordance with a vertical movement of the float 3 (and activation of the permanent magnet 2), is mounted within the connector 4. More specifically, a mounting tubular portion 6 for mounting the connector 4 is formed on the bottom surface of the reservoir body 1. The tubular portion 6 has opposite ends that define a hollow passageway through which the connector 4 is inserted. The tubular portion 6 has an attachment hole 7 in which a retaining pawl 8 (described later) of the connector 4 is engaged.

Figure 2:
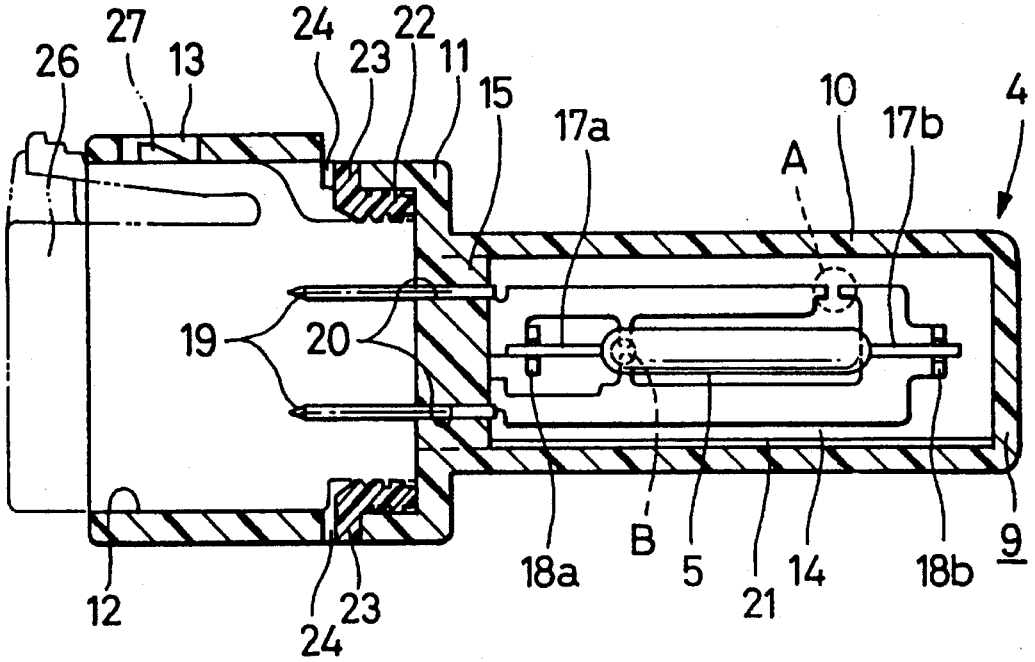
FIG. 2 is a horizontal cross-sectional view of the connector.
Figure 4:
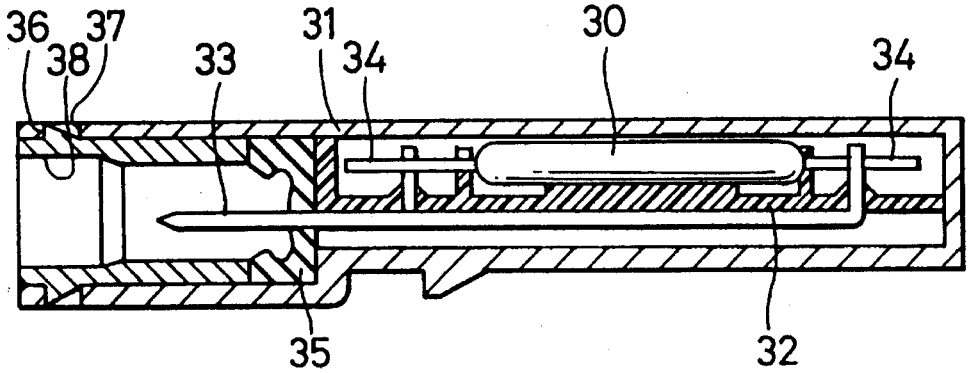
FIG. 4 PRIOR ART
FIG. 4 is a vertical cross-sectional view of a conventional connector.

The connector 4 comprises a connector housing 9 of a thermoplastic resin, and the housing 9 comprises a reed switch-receiving portion 10 of a circular cross-section defined by its rear portion, and a tubular hood portion 11 of a square cross-section defined by its front portion, the hood portion 11 being coaxial with and slightly larger in size than the receiving portion 10. The front end of the hood portion 11 is open to provide an insertion port 12 for a mating connector 26 (FIG. 2). The hood portion 11 can be closely fitted in the mounting tubular portion 6, and the retaining pawl 8 is formed on and projects from the outer surface of the hood portion 11. A retaining hole 13 is formed through that portion of the side wall of the hood portion 11 disposed adjacent to the insertion port 12. When the mating connector 26 is connected to the connector 4, an elastic pawl 27 formed on the mating connector 26 is elastically engaged in the retaining hole 13 to hold the two connectors in a connected condition. The reed switch 5 is supported on a plate 14 in a manner described below, and is inserted into the receiving portion 10 of the connector housing 9 in such a manner that the reed switch is integrally connected to a holder 15.

A contact portion of the reed switch 5 is sealed by a glass tube 16, and a pair of electrodes 17*a* and 17*b* are extended from opposite ends of the glass tube 16, respectively. The two electrodes are fitted respectively in a pair of bifurcated receiving pieces 18*a* and 18*b* formed upright on the plate 14 and are soldered thereto, thereby supporting the reed switch 5. The plate 14 is made from an electrically-conductive metal plate, and has a generally frame-shape. A pair of terminals 19 extend from one end of the plate 14. The plate 14, before integral connection to the holder 15, is a single plate, but after this integral connection, the plate 14 is cut or severed at two points A and B (FIG. 2), thus breaking a short-circuiting condition of the plate 14. This allows the soldering operation and the handling to be done more easily with the two terminals 19 integrally connected together rather than with these terminals disconnected from each other.

The holder 15 is made of a thermoplastic resin and has a pair of insertion slits 20 formed therethrough in parallel relation to each other. The two terminals 19 are press-fitted in the two slits 20, respectively. The holder 15 is integrally connected to the reed switch 5 and the plate 14, and in this condition the holder 15 is fitted in a boundary portion of the receiving portion 10 disposed immediately adjacent to the hood portion 11. In the fitted condition of the holder 15, the connector housing 9 is placed on an ultrasonic welding device of a conventional type, for example, and the holder 15 and the housing 9 are fused at an area of contact therebetween over the entire periphery, thereby fixing the holder 15 to the housing 9.

A plurality of stopper ridges 21 limit the depth of insertion of the holder 15. The stopper ridges are formed on the inner surface of the receiving portion 10 and extend along the length of the receiving portion at radial positions.

Figure 3:
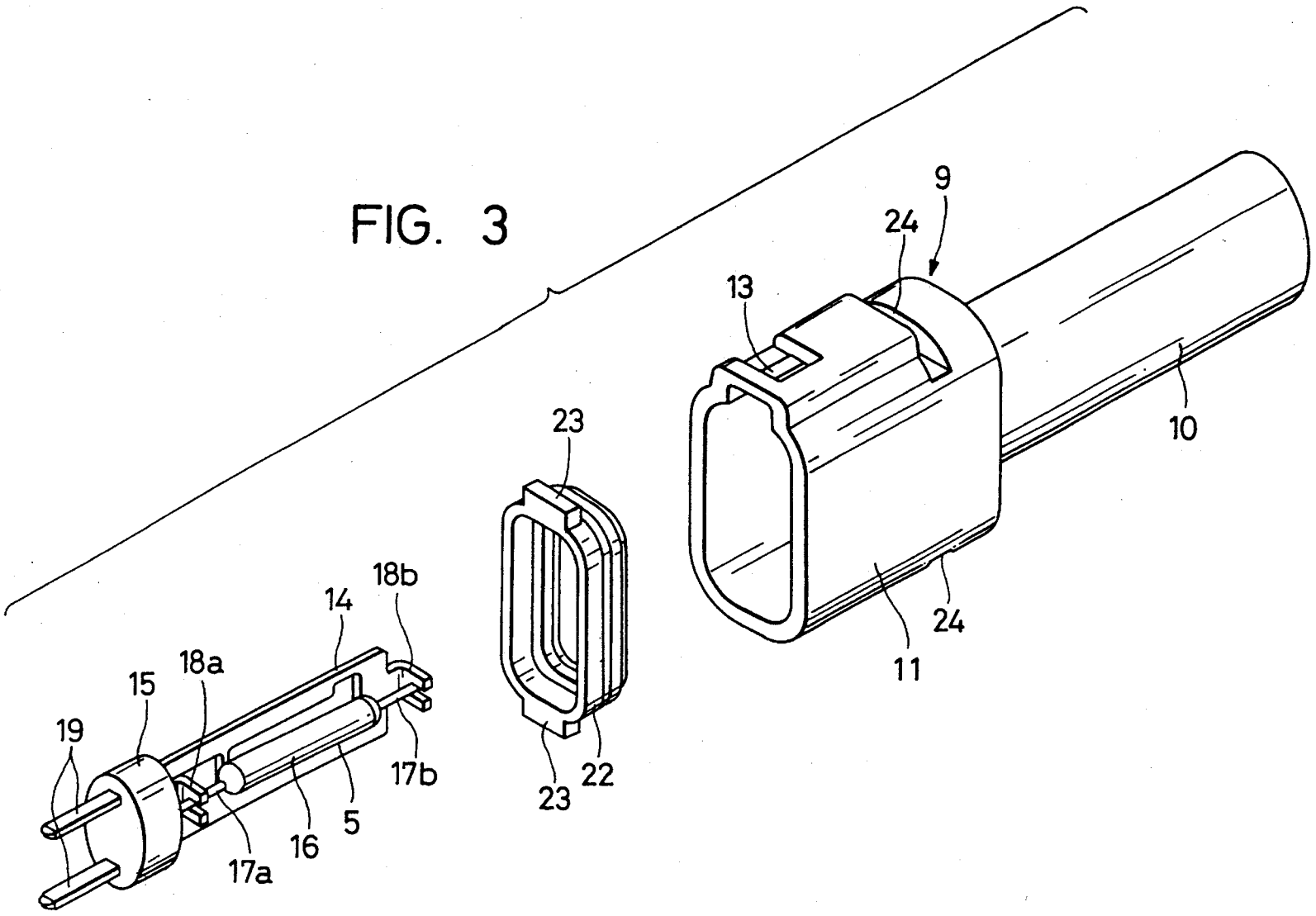
FIG. 3 is an exploded, perspective view of the connector.

A rubber bushing 22 has a generally rectangular cross-sectional, tubular shape as a whole, and is closely fitted in an inner end portion of the hood portion 11 in surrounding relation to the terminals 19. The rubber bushing 22 can closely fit on the outer peripheral surface of the mating connector 26 to prevent water or the like from intruding to the terminals 19. A pair of projections 23 are formed symmetrically on the rubber bushing 22 at its open end portion. The two projections 23 are engageable respectively in opposed retaining grooves 24 (FIG. 3), formed respectively in upper and lower walls of the hood portion 11, so as to prevent the rubber bushing 22 from withdrawal.

Next, the operation for inserting the reed switch 5 and the associated parts into the connector housing 9 will be described. First, the two terminals 19 of the plate 14 are press-fitted respectively in the slits 20 in the holder 15. At this time, the plate 14 is in a condition (see FIG. 3) prior to the condition of FIG. 2 in which the plate 14 is cut at the two points A and B. Then, the two electrodes 17*a* and 17*b* of the reed switch 5 are fitted respectively in the receiving pieces 18*a* and 18*b* of the plate 14, and are soldered to these receiving pieces, respectively. Thus, the reed switch 5 is integrally connected to the plate 14 by the holder 15, and thereafter the plate 14 is cut at points A and B.

In this condition, that side of the assembly having the reed switch 5 is inserted into the connector housing 9, and the assembly is inserted into the receiving portion 10 until the holder 15 is brought into engagement with the stopper ridges 21. Then, the connector housing 9 is put on the ultrasonic welding device, and ultrasonic vibrations are applied to the area of contact between the holder 15 and the receiving portion 10 to fuse this contact area, so that the holder 15 is fixedly secured to the inner surface of the receiving portion 10. Thus, the reed switch 5 is sealed in the receiving portion 10 in a stable posture. After fixing the holder 15, the rubber bushing 22 is fitted, and the two projections 23 are engaged in the retaining grooves 24, respectively. As a result, the rubber bushing 22 is fixed, and the assembling operation relative to the connector housing 9 is completed. Then, the connector housing 9 is inserted into the mounting tubular portion 6 of the reservoir body 1, and the retaining pawl 8 is engaged in the attachment hole 7, thereby securing the connector 4 to the reservoir body 1.

As described above, in this embodiment, the reed switch is supported directly on the plate, and therefore the support member as used in the conventional construction is not needed. Furthermore, because the holder is fusingly fixed, the use of any special part for preventing the withdrawal of the reed switch and the associated part can be omitted, and therefore the internal structure is simplified. The number of the constituent parts is reduced as compared with the conventional construction, and therefore the required time and labor as well as the cost can be reduced. Moreover, because the reed switch 5 is integrally connected to the holder 15, being composed of a resin, the insertion of this assembly into the connector housing can be carried out more easily as compared with the conventional construction in which such an assembly is inserted, together with the rubber bushing, into the connector housing.

Although the connector for the reed switch has been shown in this embodiment, the component received in the connector is not limited to such a reed switch, and any suitable one of various electrical components can be received in the connector.

The invention has been described in detail with reference to preferred embodiments thereof, which are intended to be illustrative but not limiting. Various modifications may be made without departing from the spirit and scope of the invention as set forth in the appended claims.

What is claimed is:

1. A connector comprising a housing having at one end an insertion port for receiving a mating connector; an electrically conductive plate supporting an electrical component received in said housing, said plate having integrally formed terminals electrically connected to the electrical component; and a holder through which front end portions of said terminals extend toward said insertion port in a press-fitted manner, said holder being fused to said housing in such a manner that said holder is entirely fitted in said housing.

2. A method for mounting an electrical component within a housing comprising the steps of:

providing an insertion port on said housing for receiving a mating connector;

press-fitting terminals of an electrically conductive plate of the electrical component within a holder;

connecting electrodes of the electrical component with respective ones of said terminals to form an assembly;

electrically separating said terminals from each other;

inserting the assembly into the housing until the holder is inserted entirely within said housing and said holder engages stopper ridges located in the housing, said terminals extending through said holder into said insertion port, said terminals being cooperable with said mating connector;

fusing the holder to the housing.

3. The method of claim 2, further comprising the step of engaging projections of a rubber bushing within retaining grooves formed in the housing.

4. The method of claim 3, further comprising the step of mounting the housing on a tubular portion of a reservoir body.

5. The method of claim 2, wherein the electrically separating step includes severing at least one portion of the plate.

6. The method of claim 2, wherein the fusing step includes fusing the holder to the housing using ultrasonic vibrations.

7. A connector for receiving a mating connector, comprising a housing that receives an electrically conductive plate that includes separable terminals supporting an electrical component, a holder through which the terminals extend and are press-fitted, and means that seal and fix the holder with the housing after the terminals are separated from one another.

8. The connector of claim 7, wherein the plate includes two severing points that are severed before the holder is sealed and fixed to the housing.

9. The connector of claim 7, wherein the housing includes an electrical component receiving portion and a hood.

10. The connector of claim 9, wherein the hood includes a retaining groove for receiving projections of a rubber bushing, a retaining hole for receiving an engagement pawl of the mating connector, and a retaining pawl adapted for engagement with a mounting tubular portion that is attached to a reservoir body.

11. The connector of claim 9, wherein the electrical component receiving portion includes at least one stopper ridge that defines an axial extent into the electrical component receiving portion through which the holder may protrude.

12. The connector of claim 7, wherein the means that seal and fix includes means for fusing the holder to the housing using ultrasonic vibration welding.

13. The connector of claim 7, wherein the housing includes a receiving portion and a hood, and said holder and said electrical component are disposed within the receiving portion.

* * * * *